US006893598B1

(12) United States Patent
March

(10) Patent No.: US 6,893,598 B1
(45) Date of Patent: May 17, 2005

(54) FINISHING GUIDE FOR CONCRETE PIERS

(76) Inventor: Mark A. March, 5665 Gutermuth Rd., St. Charles, MO (US) 63304

( * ) Notice: Subject to any disclaimer, the term of this patent is extended or adjusted under 35 U.S.C. 154(b) by 6 days.

(21) Appl. No.: 10/656,017

(22) Filed: Sep. 5, 2003

(51) Int. Cl.[7] ..... E02D 5/38

(52) U.S. Cl. ..... 264/267; 264/310; 405/255; 405/257

(58) Field of Search ..... 405/255, 249, 405/256, 257; 404/25, 26; 249/48, 51; 52/745.17, 741.15; 264/267, 35, 310

(56) References Cited

U.S. PATENT DOCUMENTS

| | | | | | |
|---|---|---|---|---|---|
| 386,979 | A | | 7/1888 | Haase | 249/153 |
| 780,321 | A | | 1/1905 | Burkholder et al. | 249/48 |
| 945,948 | A | | 1/1910 | Higgins | 264/256 |
| 955,729 | A | * | 4/1910 | Welsh | 405/245 |
| 1,299,739 | A | | 4/1919 | Landwehr | 249/48 |
| 1,869,880 | A | * | 8/1932 | Binns | 404/44 |
| 2,390,625 | A | | 12/1945 | Swarthout | 405/255 |
| 3,377,808 | A | | 4/1968 | Dougherty | 405/250 |
| 3,956,437 | A | | 5/1976 | Ellis | 264/40.1 |
| 3,990,672 | A | | 11/1976 | Buchanan | 249/48 |
| 4,197,031 | A | * | 4/1980 | Hild | 404/26 |
| 4,790,509 | A | | 12/1988 | Cardwell et al. | 249/93 |
| 5,431,510 | A | * | 7/1995 | Reinert, Sr. | 404/72 |
| 5,492,656 | A | | 2/1996 | Tracy | 264/32 |
| 5,718,851 | A | | 2/1998 | Wadas, Jr. | 264/32 |
| 5,961,253 | A | | 10/1999 | Okawa | 405/239 |
| 6,254,314 | B1 | | 7/2001 | Park et al. | 405/255 |
| 6,457,901 | B1 | * | 10/2002 | Sondrup | 404/26 |

FOREIGN PATENT DOCUMENTS

| | | | |
|---|---|---|---|
| FR | 2607427 | * | 6/1988 |

* cited by examiner

*Primary Examiner*—Sunil Singh
(74) *Attorney, Agent, or Firm*—Grace J. Fishel

(57) ABSTRACT

A device for finishing the ends of concrete posts, piers or columns has a form for imparting a smooth transitional shape to the periphery of the concrete post, piers or columns. The form may be shaped and sized to fit into a conventional prefabricated tubular form for concrete posts, piers, columns and the like. The device may also have a central finishing plate for producing a smooth end surface to the concrete posts, piers or columns. The central finishing plate may be connected to a driver, such as a drill motor and the like, to impart a smooth finish to the end surface of concrete posts, piers or columns. The central finishing plate may also be used to center an anchor bolt.

9 Claims, 3 Drawing Sheets

FINISHING GUIDE FOR CONCRETE PIERS

BACKGROUND OF THE INVENTION

1. Field of the Invention

The present invention relates to a device for finishing the tops of concrete posts, piers and columns.

2. Brief Description of the Prior Art

Concrete posts, piers and columns are routinely used to support structures. In particular, concrete posts, piers and columns are used to support decks, light poles, horizontal beams and similar load bearing structures. Further, concrete posts, piers and columns are used to support decorative structures, signs, and warning structures, such as barriers and the like.

When concrete posts, piers and columns are constructed as footings to support a deck for example, a tubular form, such as a prefabricated paper form is often used. The paper form is usually sturdy tube of wound paper or boxboard. The tubular form is usually of circular cross section, but it could also be of square, triangular or other cross-section. Such tubular forms come in standard lengths which are cut at the job site to form a post, pier or column of the desired length. Typically, the tubular form has an uneven top edge along the cut edge.

To construct a concrete post, pier or column, a hole is usually dug into the ground surface. The hole is sized to have a diameter greater than the diameter of the tubular form. The tubular form is then placed in the hole and the annular space between the tubular form and the earth is backfilled with rock, rubble, dirt or other material to stabilize the tubular form and to hold it in an upright, substantially vertical position. When the tubular form is stabilized, the interior of the tubular form is filled with concrete.

The concrete is allowed to set and after an appropriate time the tubular form is removed from the exposed upper end of the concrete post, pier or column. When the tubular form is removed from the exposed end of the concrete post, pier or column it commonly removes chips of concrete along the top rim, forming a rough and uneven top on the concrete post, pier or column. Further, as the top of the concrete post, pier or column may have been formed in a tubular form with an irregular cut end, and the tubular form may have been imperfectly installed in the ground, the upper surface of the top of the concrete post, pier or column will often be uneven and off the horizontal plane.

U.S. Pat. Nos. 386,979, 780,321, 945,948, 1,299,739, 2,390,625, 3,377,808, 3,956,437, 3,990,672, 4,790,509, 5,492,658, 5,718,851, 5,961,253 and 6,254,314 are incorporated by reference herein.

BRIEF SUMMARY OF THE INVENTION

The device of the present invention may produce smooth, attractively finished tops on concrete posts, piers or capitals. The device of the invention has a connecting structure to attach to the top of a tubular concrete form. The interior of the device of the invention has a smooth transitional shape or shapes which act as a form to cast the concrete at the top of a concrete post, pier or capital into the desired smooth finished shape or shapes.

The device of the invention may also have a movable portion which can be used to Impart a finished surface to the top of a concrete post, pier or column. The connecting structure of the device of the invention may have a central aperture to which a second element of the device of the invention may be joined. The second element may be moved over the surface of the uncured concrete post, pier or capital to impart a smooth finish to the concrete surface. In an embodiment of the device of the invention the second element may be connected to a rotary driver to finish the concrete surface by rotary motion of the second element.

The second element of the device of the invention may also be used to accurately install an anchor bolt at the top of a concrete post, pier or capital. A central opening in the second element may act as a guide to accurately place an anchor bolt at the center of the top surface of a concrete post, pier or column when the second element is joined with the first element on a top of a tubular concrete form. The device of the invention may also be shimmied and adjusted to provide an accurate horizontal top surface to a concrete post, pier or column as described further herein.

It is thus an object of this invention to provide a device which can produce smooth attractively finished tops on concrete posts, piers and columns. Another object is to provide a device which can cast smooth transitional surfaces at the tops of concrete posts, piers and columns. A still further object is to provide a device which can produce accurate horizontally oriented top surfaces on concrete posts, piers and columns. It is also an object to provide a device which can accurately install anchor bolts in the top surfaces of concrete posts, piers and columns. Other objects and features of the invention will be in part apparent and in part pointed out hereinafter.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
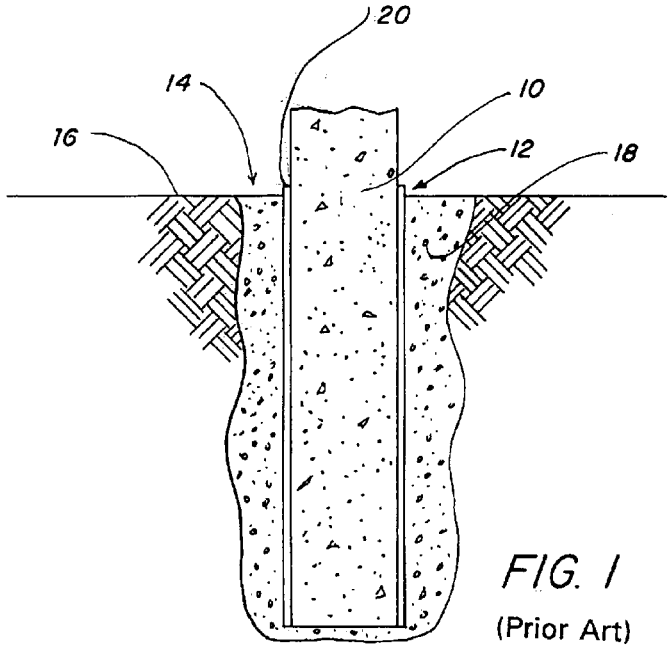
FIG. 1 (Prior Art)
FIG. 1 is a cross-sectional view of a conventional concrete pier set in a fiber tubular form.

Referring to FIG. 1, a conventional concrete pier 10 is shown. Concrete pier 10 is formed in a conventional fibrous tubular form 12 which is placed in a hole 14 formed in the ground 16. Tubular form 12 is stabilized in hole 14 by a backfill 18. Tubular form 12 is cut from a standard length of tubing and has an uneven upper edge 20, as shown. Tubular form 12 is then filled with concrete and a top 22 formed along uneven upper edge 20.

Figure 2:
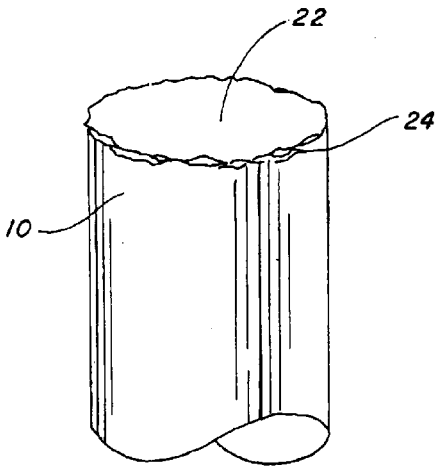
FIG. 2 (Prior Art)
FIG. 2 is a perspective view of the top of a conventional concrete pier formed in a tubular form.

Turning now to FIG. 2, when the concrete in concrete pier 10 sets the upper portion of tubular form 12 is removed to expose top 22 of concrete pier 10. As shown in FIG. 2, top 22 is uneven, due to uneven upper edge 20 of tubular form 12. Further, a peripheral edge 24 of top 22 may be chipped as tubular form 12 is parted from the concrete.

Figure 5:
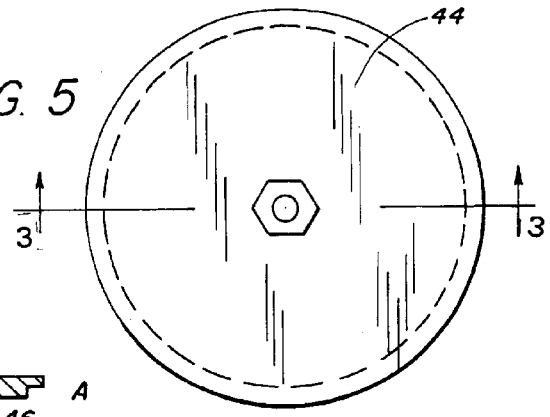
FIG. 5 is a top plan view of a portion of a fixture according to the present invention.
Figure 3:
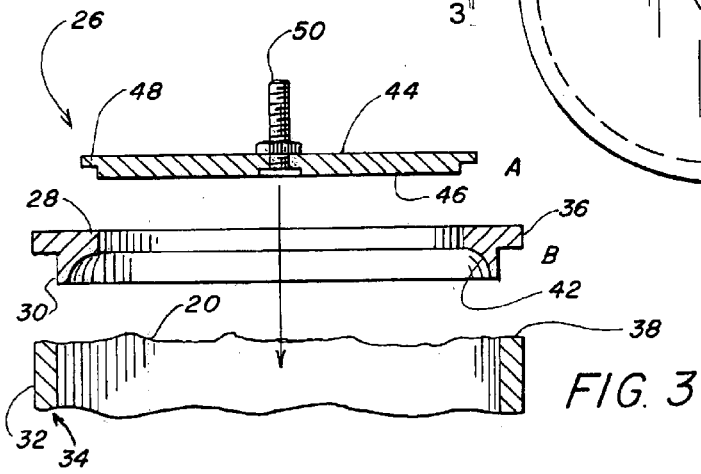
FIG. 3 is an exploded cross-sectional view of one embodiment of a fixture according to the present invention taken along the plane of 3—3 in FIG. 5 and 3—3 in FIG. 6.
Figure 6:
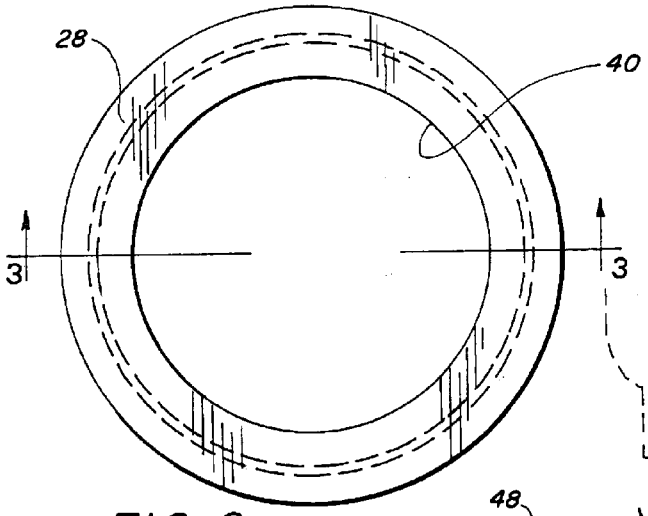
FIG. 6 is a top plan view of a portion of a fixture according to the present invention.
Figure 4:
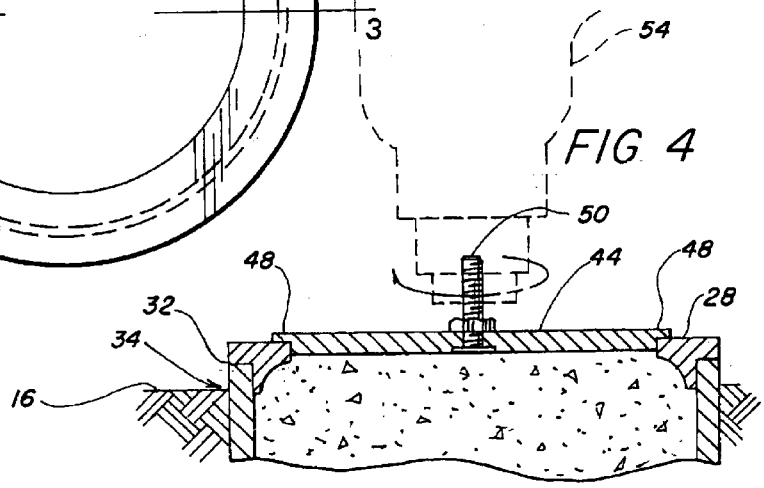
FIG. 4 is a cross-sectional view of a fixture according to the present invention installed on a tubular form.

Referring to FIGS. 3, 5 and 6, a fixture 26 according to the invention is shown. Fixture 26 has a first element 28 with a peripheral depending shoulder 30 sized to fit snugly inside a wall 32 of a tubular form 34, as shown in FIG. 4. An outwardly extending flange 36 on first element 28 rests on am upper edge 38 of tubular form 34, as shown. First element 28 has a circular central aperture 40 therein which is best seen in FIG. 6. With reference to FIG. 3, peripheral depending shoulder 30 has a smooth inner contour 42, substantially blending the inner diameter of the tubular form 34 into the inner diameter of aperture 40. As shown, smooth inner contour 42 is concave, but it will be appreciated that other geometric shapes may be used, such as bevels, chamfers, fillets and the like. It will also be appreciated that first element 28 may attach around the outer surface of tubular form 34 or may attach to both the inner and outer surface of tubular form 34, if desired.

Fixture 26 also has a second element 44. Second element 44 is a circular disk which has a central depending portion 46 which is sized to fit into central aperture 40 of first element 28, as seen in FIG. 4. An outwardly extending flange 48 rests on the upper surface of first element 28. Second element 44 also has a central drive axle 50, which may be removable, for example such as a removable fastener.

Operation of the Device

Figure 7:
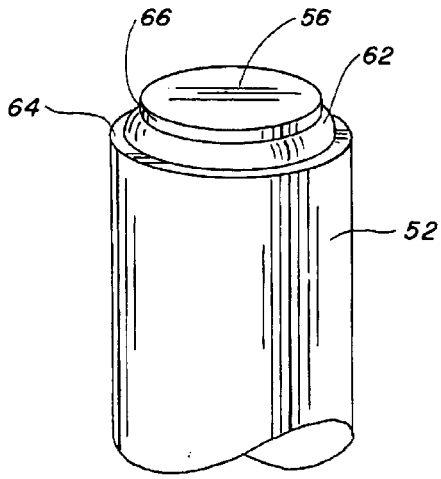
FIG. 7 is a perspective view of the top of a concrete pier formed by a fixture of the present invention.

Fixture 26 of the invention may be used to construct a concrete post, pier or column 52 having smoothly finished and attractive tops as shown in FIG. 7. In use tubular form 34 may be installed in a hole as described above for tubular form 12. Concrete for pier 52 may then be pored into tubular form 34. While the concrete of concrete pier 52 is still wet and plastic, first element 28 of fixture 26 is placed in the top of tubular form 34, as shown. If desired, a spirit level may be used to check if the upper surface of first element 28 is in the horizontal plane. If first element 28 is not level, it may be shimmed under flange 36 to adjust first element 28 to level. Alternatively, the fit between fixture 26 and tubular form 34 may be snug enough that first element 28 will remain in a selected position when placed in the top of tubular form 34.

Second element 44 of fixture 26 is then placed in central aperture 40 of first element 28, as shown. A rotary driver, such as drill motor 54, is connected to drive axle 50 of second element 44 and second element 44 is rotated to provide a smooth finish to a top 56 of concrete pier 52. If desired, a trowelling solvent, such as water, may be used to increase the smoothness of the finish.

Figure 8:
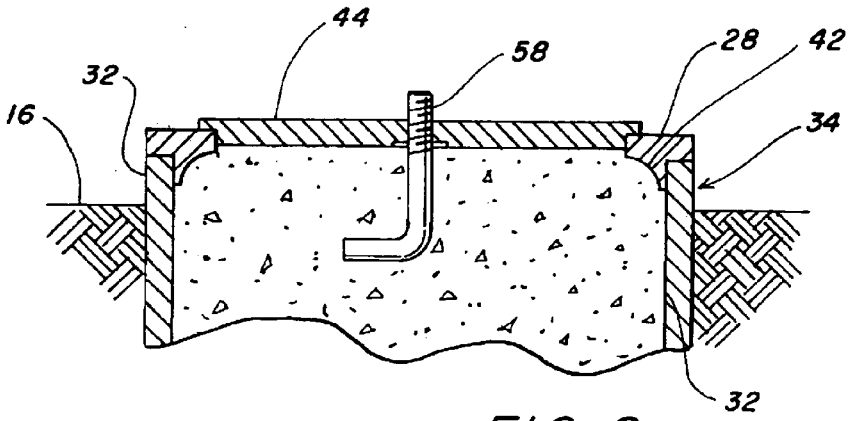
FIG. 8 is a partial cross-sectional view of the top of a concrete pier formed by a fixture of the present invention and having an anchor bolt installed therein; and, FIG. 9 is a front view of the concrete pier of FIG. 8 having a saddle installed thereon.
Figure 9:
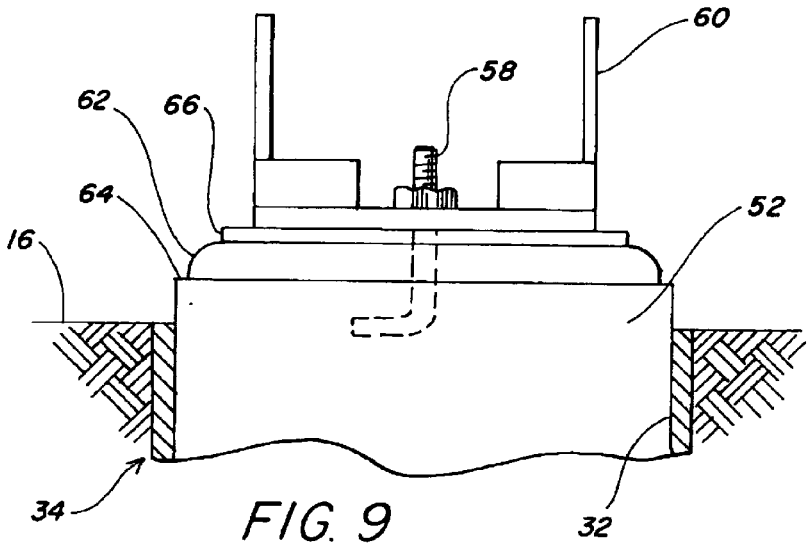

As shown in FIG. 8, second element 44 may be used to accurately set an anchor bolt 58 in concrete pier 52. While the concrete of concrete pier 52 is still wet and plastic second element 44 is removed from top 56 of concrete pier 52. Drive axle 50 is removed from second element 44 and an anchor bolt 58 is inserted into second element 44, as shown. Second element 44 is then returned to top 56 of concrete pier 52 and into central aperture 40 of first element 28. Anchor bolt 58 is pressed into the mass of wet concrete, as shown.

When the concrete in concrete pier 52 has set, first element 28 and second element 44 of fixture 26 may be stripped from concrete pier 52. The upper portion of tubular form 34 may also be removed, as shown. Top portion 56 of concrete pier 52 is thus provided with a smooth attractive finish at shown in FIG. 7 with a minimum of unsightly chips and spalls. Top surface 56 also has a desirable horizontal orientation. If anchor bolt 58 is used, it is accurately placed in the center of top surface 56 of concrete pier 52. The accurate installation of a saddle 60 onto concrete pier 52 is thus simplified and the saddle can accurately receive the structure which it is intended to support, such as a deck member not shown.

As shown, elements 28 and 44 of fixture 26 are sized and shaped to provide a smooth convex ring 62 at top 56 of concrete pier 52. Smooth peripheral convex ring 62 is located between horizontal shoulder 64 and vertical shoulder 66, also formed by elements 28 and 44, to produce a compound smooth transitional surface 62, 64 and 66, as shown. If desired however, elements 28 and 44 of fixture 26 can be sized to eliminate the steps between wall 32 of tubular form 34 and elements 28 and 44, shown in FIG. 4, which produce peripheral shoulders 64 and 66. The modified elements 28 and 44 thereby produce a continuous smooth curved ring 62 at top 56 of concrete pier 52. Moreover, other shapes may be used to finish top 56, as previously described.

Fixture 26 of the invention may be fabricated by a variety of conventional techniques, as will be appreciated by those skilled in the art. The materials of construction are inexpensive. Conventional metals may be used as well as wood, plastic, pressboard and fiberboard. The fixture may be painted or coated with a release material, such as wax, to simplify stripping the fixture from a set concrete pier.

It will be appreciated by those skilled in the art that the specifics of the embodiments disclosed are illustrative and may be changed or modified without departing from the spirit of the invention. The invention is not to be limited to the specifics of the disclosure herein, but only by the appended claims and their equivalents.

What is claimed:

1. A device for finishing the ends of concrete posts, piers or columns comprising a paper tubular concrete form and an annular first element having a flange extending outwardly for abutment with a top edge of the paper tubular concrete form and a depending member extending into a top end of the paper tubular concrete form, said depending member forming a smooth transitional surface between the inside of the paper tubular concrete form and the first element whereby concrete posts, piers or columns cast in the device are finished with a smooth imprint of said depending member and transitional surface, said device further comprising a second element, the second element being received and movable in the first element, whereby the second element is effective to impart a smooth finish to the top of a concrete post, pier or column cast in the device.

2. The device of claim 1 wherein the first element has a concave transitional surface.

3. The device of claim 1 wherein the depending member fits snugly into the paper tubular concrete form.

4. The device of claim 1 wherein the second element has an upwardly extending drive axle located therein.

5. The device of claim 4 wherein the drive axle is adapted for attachment to a source of rotary motion to impart relative rotating movement between the first element and the second element.

6. The device of claim 5 wherein the drive axle is removable.

7. The device of claim 6 wherein an anchor bolt may be received in the second element after the drive axle has been removed.

8. The device of claim 1 wherein the second element has an outwardly extending flange at a periphery thereof, the outwardly extending flange extending at least partially over the first element.

9. The device of claim 1 wherein the smooth transitional surface of the first element has a compound shape.

* * * * *